United States Patent [19]

Keep, Jr.

[11] 4,391,425

[45] Jul. 5, 1983

[54] RAILROAD SWITCH HEATER

[76] Inventor: Henry Keep, Jr., 88 E. Warf Rd., Madison, Conn. 06443

[21] Appl. No.: 267,791

[22] Filed: May 28, 1981

Related U.S. Application Data

[63] Continuation-in-part of Ser. No. 107,398, Dec. 26, 1979, abandoned, which is a continuation-in-part of Ser. No. 890,637, Mar. 20, 1978, Pat. No. 4,195,805.

[51] Int. Cl.[3] ..... E01B 7/24

[52] U.S. Cl. ..... 246/428; 104/280; 126/271.2 B; 174/88 C

[58] Field of Search ..... 246/428; 104/279, 280; 219/535, 536, 537, 213, 548, 544; 174/88 C; 339/89 C, 89 R, 90 C, 177 R, 177 E; 126/271.1, 271.2 B

[56] References Cited

U.S. PATENT DOCUMENTS

| | | | |
|---|---|---|---|
| 682,768 | 9/1901 | Taylor | 246/428 |
| 1,329,007 | 1/1920 | Paige | 246/428 |
| 1,524,223 | 1/1925 | Wells | 246/428 |
| 1,664,371 | 3/1928 | Moffett et al. | 246/428 |
| 2,091,849 | 8/1937 | Finlayson | 246/428 |
| 2,379,942 | 7/1945 | Webber | 174/88 C |

FOREIGN PATENT DOCUMENTS

| | | | |
|---|---|---|---|
| 2129878 | 12/1972 | Fed. Rep. of Germany | 246/428 |

*Primary Examiner*—Bruce H. Stoner, Jr.
*Assistant Examiner*—Donald Hajec
*Attorney, Agent, or Firm*—Albert C. Johnston

[57] ABSTRACT

A railroad switch heating system comprises lengths of a pliable insulated electrical resistance heating cable disposed against and along the outer sides of the fixed rails of the switch, with portions of these cable lengths between rail braces overlaid by thermally insulating mats and against the adjacent rail web surfaces, and supplemental heating to prevent ice formation in the crib space of, and excessive heat losses through, a rod interconnecting the displaceable rails near the switch points is provided by a crib heating unit having a sinuously bent length of the cable arranged over a pan-like support of sheet material that fits between and along the ties bordering the crib space beneath the rod therein. The pan-like support becomes heated by conduction and heats substantially the entire crib space by radiation and convection. Where the switch points move on a gauge plate extending between them on a track tie, the fixed rail heating is further supplemented by heating units that include rigid plate members which straddle and hold sinuously bent lengths of the cable against areas of the gauge plate near the switch points, with heat insulation. Each cable length has the ends of its heating wire fitted with connectors joining it with insulated conductors in a series heating circuit to be activated when weather conditions might cause freezing at the switch. Lengths of bendable metal tubing enclosing the cable lengths and special water-tight connectors render the heating system water-tight, thus enhancing its safety and reliability.

8 Claims, 13 Drawing Figures

RAILROAD SWITCH HEATER

This application is a continuation-in-part of application Ser. No. 107,398 filed Dec. 26, 1979, now abandoned, which was filed as a continuation-in-part of application Ser. No. 890,637 filed Mar. 20, 1978, now U.S. Pat. No. 4,195,805.

This invention relates to apparatus for heating a railroad switch so as to prevent obstruction of the switch operation by ice or snow in cold weather conditions. The invention relates more particularly to apparatus for heating not only the fixed rails at a switch but also structures extending between the moveable switch rails, such as one or more tie or throw rods and/or a track gauge plate, where needed to supplement the heat imparted to such structures by conduction from the heated fixed rails.

In climatic regions which frequently experience temperatures below freezing, malfunction of railroad track switches is often a problem. This difficulty is compounded by frequent precipitation in the form of snow or freexing rain. Temperatures below freezing and accumulations of snow or ice result in malfunction of railroad switches for several reasons. Snow accumulated between a fixed rail and an adjacent movable rail of a switch can pack and prevent proper engagement of the two rails. Ice formed about or on the point of a movable rail or between it and a fixed rail may prevent proper engagement or separation of the two rails when required for switching a train or railroad car from one track to another.

The crib spaces between adjacent ties of a railroad switch, which accommodate the rod or rods, such as one or more tie rods and/or a throw rod, interconnecting the movable rails are also susceptable to heat losses and to accumulations of snow or ice that can interfere with the proper operation of the switch. Further, even when the fixed rails in the region of a switch are heated suitably for keeping them clear of ice and snow, under extreme weather conditions a gauge plate joining the fixed rails on a track tie at the location of the switch rail points can become a source of switch malfunction by dissipating so much heat that ice will form on the gauge plate and obstruct or prevent displacement of the switch points. Malfunction of the switch of course can cause a train or cars moving over it to derail, with severe hazards of property damage and personal injury.

The heating of a railroad rail switch to prevent failure or unreliability of the switch operation under cold weather conditions involves a variety of problems and needs. The heating apparatus to be employed must serve reliably to keep the switch clear of ice and snow, with safety and efficiency in its operation, economy in the production and installation of its component parts, and assurance that failures of operation due to burn-out or other cause will not occur over long periods of service. It is also important that the apparatus be susceptible to safe installation by railroad workmen, to prompt repair at the switch location in the event of damage by accident or otherwise, and to fast removal and replacement whenever needed to enable repair or replacement of the rails, ties, or other structures at the switch.

These problems and needs in large part have been met satisfactorily by the railroad switch heater disclosed in applicant's above-mentioned U.S. Pat. No. 4,195,805. The apparatus disclosed therein, however, left some needs continuing in respect of the crib regions of switch rail connecting rods, and also, for some installations, in respect of the above-noted problem of ice formation on a track gauge plate. When lengths of heating cable are extended through crib spaces as disclosed in said patent, conditions can occur under which an accumulation of ice or snow immediately adjacent the heating cable will be melted without melting through the top of the accumulation, thus leaving about the heating cable a tunnel or "igloo" of ice or snow within which air insulates the cable so that the heat from it will not reach the tie or throw rod.

The principal object of the present invention is to provide a new and improved apparatus or system for heating components of a railroad switch in a reliable, safe, efficient and economical manner.

Another object of the invention is to provide for a heated railroad switch an apparatus by which the crib space of each tie or throw rod interconnecting the displaceable end portions of switch rails will be heated so that heat losses through the rod are compensated and the rod and the crib space are kept clear of ice and snow.

A further object of the invention is to provide for a heated railroad switch an apparatus by which the hazard of a switch rail point becoming iced or obstructred at the location of a gauge plate can be overcome reliably.

The heating system or apparatus of the present invention is applicable safely, efficiently, and reliably for preventing malfunctions of railroad switches of any of the various types and sizes existing in railroad operations. A railroad switch of any type or size typically includes fixed rails engaged by braces and fastened to track ties, switch rails having end portions terminating in points that are displaceable laterally relative to the fixed rails, and at least one rod interconnecting and displaceable with these rail end portions, with each rod extending along a crib space between adjacent track ties.

According to the present invention, use is made of lengths of an electrical heating cable that comprises an electrical resistance heating wire encased in high temperature resistant electrically insulating material confined inside a thermally conductive, pliable metal sheath. The heating wire of each length of this cable is provided on each of its ends with means for connecting it in a circuit containing the wires of the other cable lengths of the system and a source of current for heating the several wires to high temperature.

A length of such heating cable is disposed against and along the outer side of each fixed rail of the switch in heat conducting relation thereto through the region of the displaceable rail end portions, and elongate mats of high temperature resistant thermal insulation are confined, as by channel members formed of extruded or sheet metal, against the portions of these cable lengths that are not engaged with rail braces and against the rail surfaces adjacent to such cable portions, so as to prevent heat losses by convection and radiation.

The heating of the fixed rails by conduction from the cable lengths disposed against them results in more or less effective conduction of heat through gauge or switch plates to the switch points and to structures such as one or more tie rods or a throw rod interconnecting the displaceable rail end portions. This resultant heating is supplemented according to the invention by a crib heating unit fitting into each crib space beneath and along the rod therein, each of which crib units comprises a unitary elongate, substantially flat pan-like support of thermally conductive, heat and weather resistant sheet material, such as stainless steel or aluminum sheeting, which is dimension to fit between and along the ties bordering the crib space, with a sinuously bent length of the electrical heating cable arranged over and held to a surface of the pan-like support so as to heat the support substantially uniformly by conduction and thus heat substantially the entire region of the crib space by convection and radiation.

According to a further feature of the invention as it is applied to a switch having the fixed rails positioned by a gauge plate on which the switch rail points are slidable to and from the fixed rails, the gauge plate is provided with a supplemental heating unit fitted over a surface of this plate adjacent to each of the switch points. This heating unit comprises a rigid plate member having a substantially flat base wall overlying the gauge plate surface and having depending side walls fastened to opposite sides of the track tie under the gauge plate, with a layer of heat insulating material fixed beneath the base wall, and another sinuously bent length of the heating cable is arranged on and held to the insulating layer and is held by the plate member directly against the gauge plate surface for heat conduction into the gauge plate. Each end of the heating wire of this other cable length protrudes from beneath the base wall of the plate member into means for connecting the wire in a circuit as mentioned above.

According to a further feature of the invention, each heating cable length of the switch heating system is enclosed inside a substantially coextensive length of water-impervious, bendable tubing, so that the switch heating system can be kept substantially waterproof.

By still another feature of the invention, the means for connecting each end of the heating wire of each cable length in the heating circuit is provided in the form of a special substantially water-tight connector joining detachably an insulated electrical conductor forming part of a current supply circuit with the heating wire end and an end of a tubing length enclosing the cable length. The connector comprises a heat-absorbing electrically and thermally conductive tubular core member receiving and clamped onto the heating wire end and an end of the cold wire of the insulated conductor. This core member is enclosed in electrically insulating material confined inside a sleeve having a coupling ring fixed onto each of its ends. A threaded cap ring is fixed onto an end of the tubing length and joined with one of the coupling rings, as by compressing a pliable ring fitted inside the cap ring onto the tubing while being screwed onto the coupling ring. A protective flexible shield fitting over the insulated conductor carries a collar that is joined with and compresses an elastic gasket against the other coupling ring, as by being screwed onto it. Thus, a water-tight joint is provided that prevents the cold wire from becoming overheated and also excludes water so as to prevent current from leaking from the hot wire to the metal sheath of the cable; yet at any of the connectors, the coupling rings can be disconnected so as to enable movement of the sleeve and the insulating material away from the conductive core member clamped onto the wire ends, whereupon either or both of the wire ends can be released readily, or re-engaged readily, for removal or replacement of a component of the switch heating system.

The above mentioned and other objects, features and advantages of the invention will be further evident from the following detailed description and the accompanying drawings of an illustrative embodiment of the invention. In the drawings.

Figure 1:
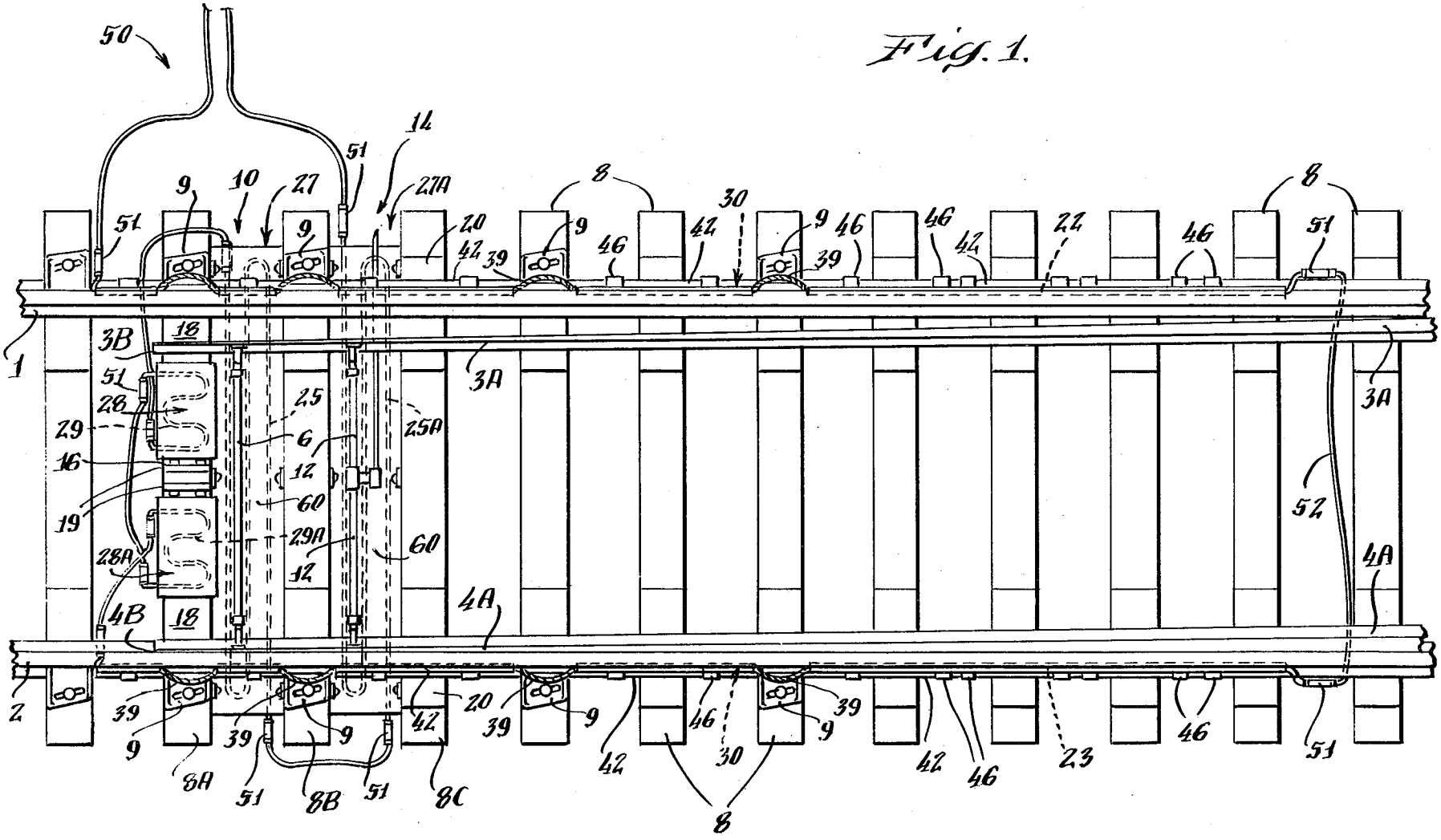
FIG. 1 is a plan view of a railroad switch provided with heating apparatus in accordance with the invention.

A typical railroad switch to be equipped with heating apparatus according to the present invention, as illustrated in FIG. 1 of the drawings, comprises two fixed rails 1 and 2, called stock rails, with switch rails 3 and 4 extending between them to displaceable end portions 3A and 4A, respectively, which terminate in switch points 3B and 4B. The fixed rails are fastened to track ties 8 and in the region of the switch are supported at intervals along their outer sides by track braces 9 fixed to ties. The switch points 3B and 4B are joined together by at least one rod, such as rod 6, that extends along a crib space, such as the space 10 between ties 8A and 8B, and forms a part of or is connected with a switch throw rod so as to be displaceable by a switch operating mechanism or "machine" (not shown) located to one side of the track.

When the switch mechanism holds switch point 3B engaged against fixed rail 1, switch point 4B is spaced away from fixed rail 2 and a track for train or car transport is formed by rails 2 and 3. When switch point 4B is held engaged with rail 2, point 3B is spaced away from fixed rail 1 and the transport track is formed by rails 1 and 4. Depending upon the length of the displaceable rail end portions 3A and 4A, which in turn differs for different duties and sizes of railroad switch installations, these displaceable rail portions are connected together not only by at least one switching rod such as rod 6 but also by one or several additional tie rods such as the one shown at 12 in FIG. 1. Each such tie rod extends in and along a crib space between two track ties, such for instance as the space 14 for rod 12 between the ties 8B and 8C. In some railroad switches, such as switches of narrow gauge tracks, mine car tracks, or the like, a single tie rod in a single crib space adjacent to the switch points suffices for both bracing and switching the displaceable end portions of the switch rails.

At the location of the switch points 3B and 4B a track tie such as the tie 8B often is provided with a gauge plate 16 that is fixed onto the tie and extends over it under and between the rails. The gauge plate is formed with recesses 17 in which the base flanges of the fixed rails are seated at the required distance apart, and it provides surface areas 18 which support the switch points for sliding movement to and from their respective track forming positions against the inner sides of the fixed rails. The gauge plate typically is composed of two heavy steel plate sections having connecting portions 19 bolted together near the center of the track, with electrical insulation sandwiched between these plate portions. At locations away from the switch points, relatively short switch plates 20 usually are fixed onto the ties, each beneath a fixed rail and the adjacent displaceable rail end portion, to keep these rails properly aligned.

As shown in FIGS. 1, 2, 3 and 4, according to the present invention, the illustrative railroad switch is provided with a heating apparatus which comprises lengths 22 and 23 of a high temperature electrical heating cable 30 disposed against and along the outer sides of the fixed rails 1 and 2 in heat conducting relation thereto throughout the region of the displaceable rail end portions 3A and 4A, and also, for each crib space occupied by a rod interconnecting the displaceable rail end portions near the switch points 3B and 4B, such as the crib space 10 of rod 6 and the crib space 14 of rod 12, a sinuously bent length 25 or 25A of the heating cable forms part of a sheet-like radiant heating unit 27 or 27A. Further, for a switch as illustrated that has the fixed rails positioned by a gauge plate 16 on which the switch points are slidable to and from their working positions, supplementing heating is provided by gauge plate heating units 28 and 28A each of which comprises another sinuously bent length 29 or 29A of the heating cable held as hereinafter described in heat conducting relation to the gauge plate surface at a location adjacent to a switch rail.

Figures 5, 6, 7A, 7B:
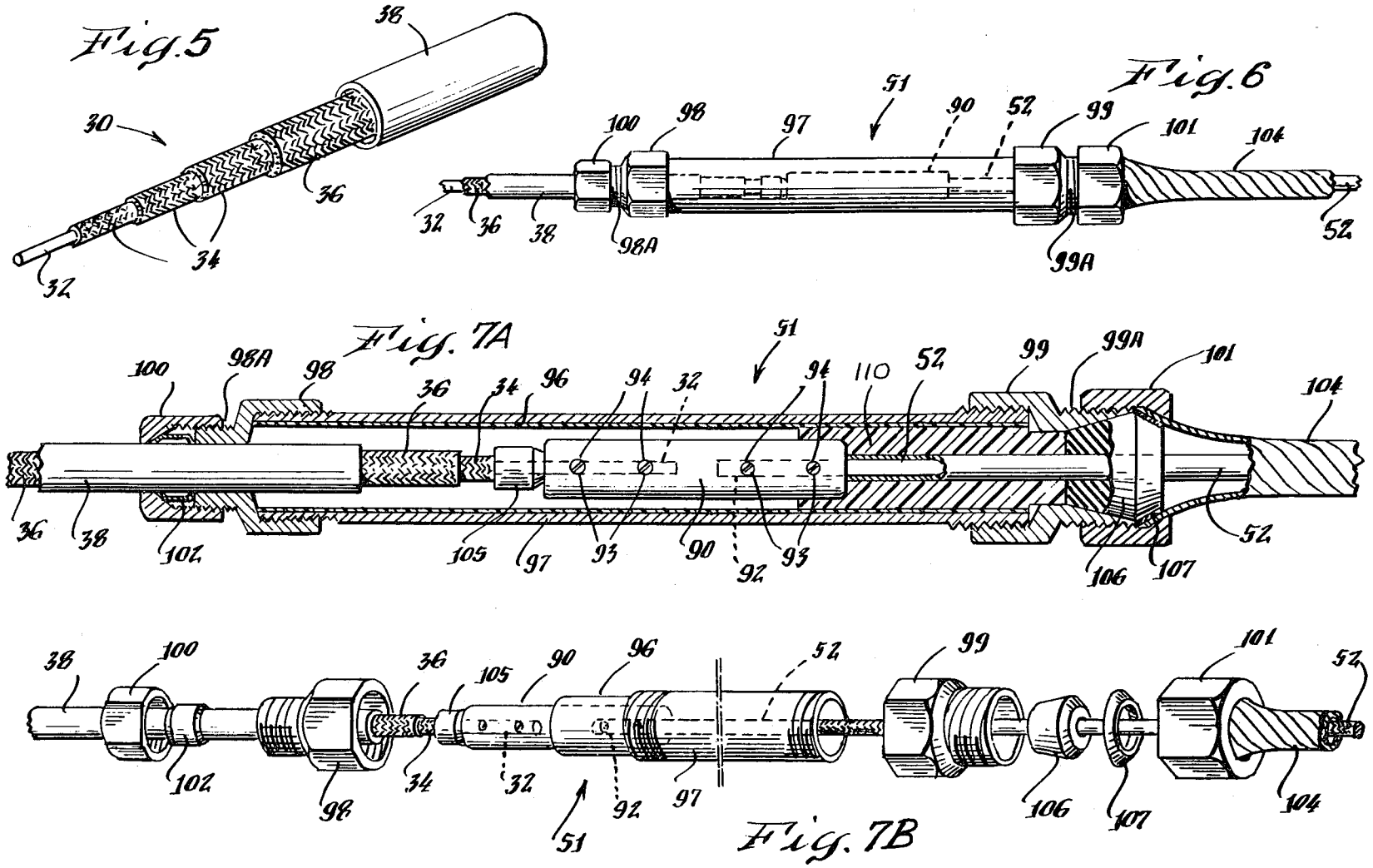
FIG. 5 is a perspective view of components of the electrical heating cable with an enclosing tubing fitted thereover.
FIG. 6 is an elevational view of a connector joining an end of a heating cable length and tubing enclosing it with an insulated current conductor.
FIG. 7A is a longitudinal cross-sectional view of the connector assembly.
FIG. 7B is a perspective view of disassembled parts of the connector.

The cable 30 of each of the heating cable lengths advantageously is of the kind disclosed in U.S. Pat. No. 3,774,013. As shown in FIG. 5, the cable comprises a core wire 32 that is a single solid strand of high temperature electrical resistance heating wire, with a sheath 34 of highly heat resistant electrically insulating material braided on the wire and confined inside a thermally conductive shielding layer 36, or outer sheath, of heat-resistant wire braided upon the insulating sheath. The core wire 32, for instance, is a No. 12 gauge wire of a nickel-chromium alloy, such as the alloy of 80% nickel and 20% chromium known as Nichrome, having a diameter of about 0.081 inch. The electrically insulating sheath 34 in a preferred embodiment is formed of several layers of a ceramic fiber, typically three, braided one over another onto the wire core 32. A commercially available ceramic fiber made of an alumina-boria-silica composition and identified as "3M Fiber AB-312," if suitably pre-treated to burn off a sizing that may carbonize at high temperature, is advantageous for making the insulating sheath. This material when so pre-treated exhibits excellent dielectric properties and retains needed flexibility after long periods of heating to temperatures in excess of 2,000° F., which exceed the temperature reached by the heating wire 32 in use in the switch heating apparatus. Alternatively, the insulating material may be composed of other ceramic substances that will resist temperatures of at least about 2,000° F., over long periods of service, such for instance as an amorphorous silica fiber known as "REFISIL." The shielding layer 36 confining the insulating material 34 is a pliable sheath composed of a metal highly resistant to heat, abrasion and oxidation, and preferably is formed by braiding wires of a copper-nickel alloy such as "INCONEL" into a sleeve fitting tightly on the insulating sheath.

It has been found that the components of the heating cable 30 expand and contract linearly to nearly the same extent in response to changes in temperature, so that little or no wear of the insulating material occurs in the use of the cable as a result of abrasion between the wire or the metal sheath and the insulating material. Consequently, the cable is highly resistant to deterioration and burn-out in the service required of it according to the present invention.

As indicated further in FIG. 5, each length of the heating cable 30 is enclosed advantageously inside a length of water-impervious, bendable metal tubing 38, such for instance as extruded aluminum tubing having an inside diameter of about 0.5 inch and a wall thickness of about 0.05 inch. Each tubing length 38 is substantially coextensive with the cable length enclosed in it. By excluding water from access to the heating cable 30 the tubing 38 prevents current losses, short circuit or burn-out from being caused by water or other liquid that otherwise might be accessible to the cable at the switch location. The risk of water causing failure of the switch heating system is avoided further by the manner of connection provided for joining the wire 32 and the tubing 38 at each end of each heating cable length with an insulated electrical conductor of a current supply circuit, as described more particularly hereinafter with reference to FIGS. 7A and 7B of the drawings.

Figures 2, 3, 4:
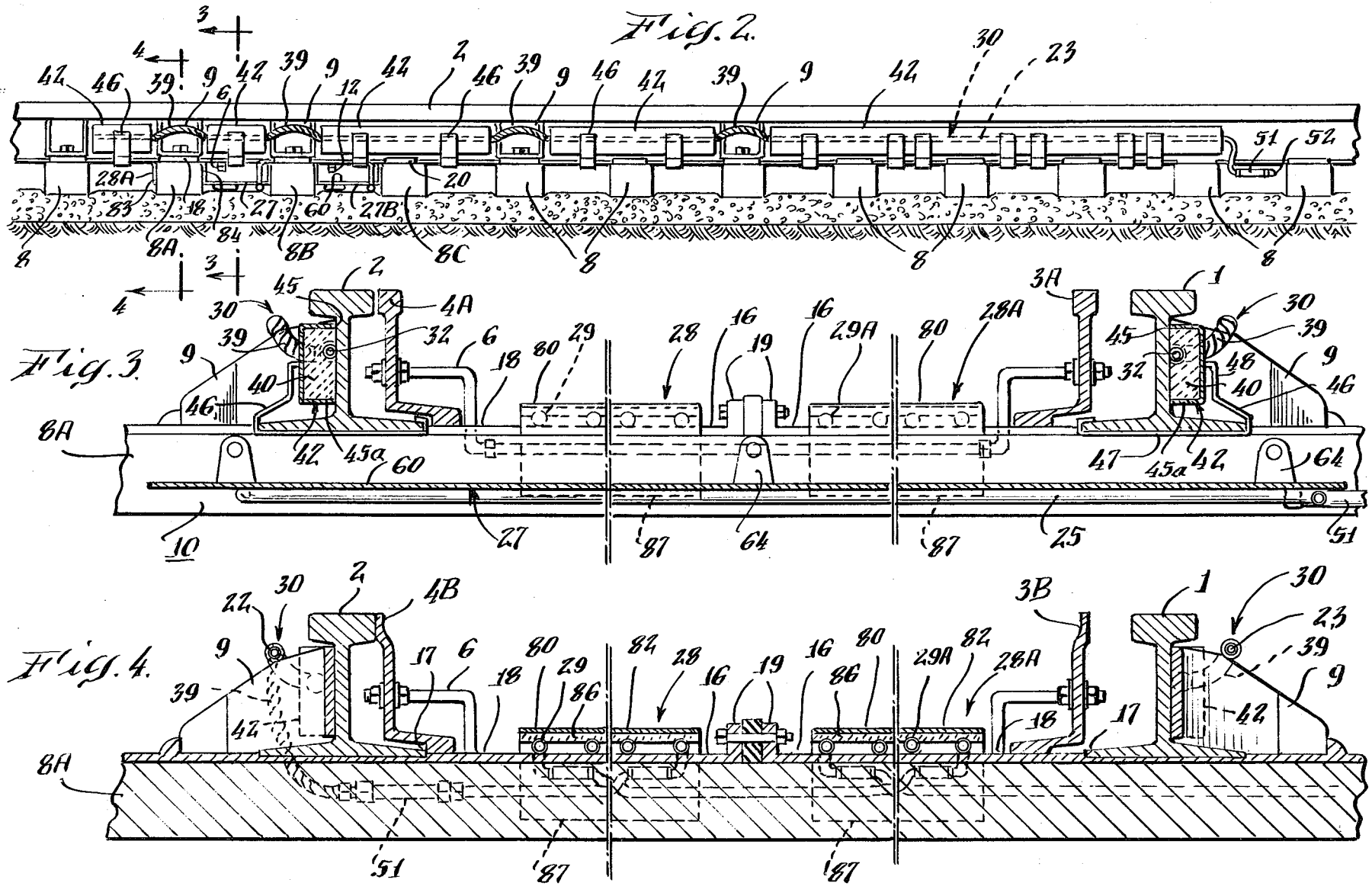
FIG. 2 is a side elevational view of the apparatus of FIG. 1.
FIG. 3 is a vertical cross-sectional view taken at line 3—3 in FIG. 2.
FIG. 4 is a vertical cross-sectional view taken at line 4—4 in FIG. 2.

As shown in FIGS. 1 and 2, the tubing-enclosed cable lengths 22 and 23 are disposed directly against and along the outer sides of the webs of fixed rails 1 and 2 at locations between the rail braces 9, and at the braces are bent over and against them so as to heat the rails by conduction through the braces. Portions of the cable lengths engaged over the braces preferably are enclosed in spiral spring guards 39 which protect the cable and tubing on the cable from being abraded by relative motions of the rails and braces. The portions of each cable length engaged directly against the rail web, i.e., those not engaged away from the web by rail braces, are embedded under elongate mats 40 of high temperature resistant thermal insulation, such as ceramic fiber insulation. The mats 40 are confined against these cable portions and against the rail web surfaces adjacent to them, as by being confined tightly inside channel members 42 clamped against the rail web, so that the mats will prevent heat losses that otherwise would occur by convection and radition. The insulating mats 40 may be formed advantageously of bonded insulating ceramic fiber, or fiber board, such for example as the commercial heat insulating material known as "K-FAX," which may be grooved longitudinally in one side to receive the cable. Another suitable form of insulating mats is made of loose ceramic fiber insulation, for instance the material known as KAOWOOL at a density of about eight pounds per cubic foot, confined in a flexible sleeve of high temperature resistant wire mesh, for example a knitted sleeve of wire known as "INCONEL 600." The wire mesh sleeve keeps the insulation pliable for fitting it over the cable up to the bordering rail web surfaces while confining the loose fiber so that it will not creep between the rail web and the heating cable or a tubing length on the cable.

The channel members 42 confining the insulating mats 40 may be extruded or otherwise formed elongate sections of a suitable substantially rigid sheet material, such as an aluminium extrusion, having a generally U-shaped cross-section and a wall thickness, for instance, of about 0.09 inch. The channel members 42 typically are made with an inside width of about 3 inches and an inside depth of about 0.75 inch, thus confining tightly against the cable and the rail surface an insulating mat 40 that in place has substantially corresponding outside dimensions. The channel members 42 can be easily fitted over the mats and the cable portions encompassed by the mats and then clamped in place at intervals, for instance of approximately one to two feet, by suitable displaceable holding devices such as the rail clips 46 shown in FIGS. 2 and 4. Each of the clips 46 comprises a flat bar of spring steel shaped to form an anchoring portion 47 and an angled upright resilient leg 48. Portion 47 is snapped onto the base flange of the rail, causing leg 48 to bear firmly against the base wall 44 of the channel member 42 so as to hold the edges 45 and **45*a*** of the channel member tightly against the rail web.

As indicated in FIG. 1, each of the heating cable lengths 22 and 23 has its core wire 32 connected at each end through a connector 51 with an insulated cold conductor 52 in a circuit 50 for supplying heating current to the cable lengths. The source of the heating current should be capable of supplying it through the cable lengths at a watt density in the range of about 20 to 60 Watts per square inch of heating wire surface. In the case of resistance wire of 0.081" diameter in a system employing about 66 to 74 feet of the cable, as for a railroad switch about 16½ feet long from the heels to the points of the switch rails, a 220 V A.C. power source will supply current through the wire at a density, for example, of about 32 Watts per square inch, or about 93 Watts per linear foot of the heating cable. Such a switch heating system typically operates with an energy consumption of the order of about 6 to 7 kilowatts per hour. For a system containing about 33 to 37 feet of the cable, a 110 V A.C. source will supply about 93 Watts per foot. The current typically will generate enough heat to bring the wires in the cable lengths 22 and 23 to a temperature, for instance, of about 1,250° F. at an ambient temperature of 0° F. The fixed rails are thus heated, for instance, to a temperature about 90° to 100° F. above the ambient. Further, the heat that sinks directly into the fixed rails will pass sufficiently to the adjacent end portions 3A and 4A of the switch rails, predominantly by conduction through the switch plates and/or portions of a gauge plate when present, though also to some extent by radiation and convection, so that accumulation of ice or snow is prevented not only along the fixed rails but also, ordinarily, along the displaceable portions of the switch rails and between them and the fixed rails.

Figure 8:
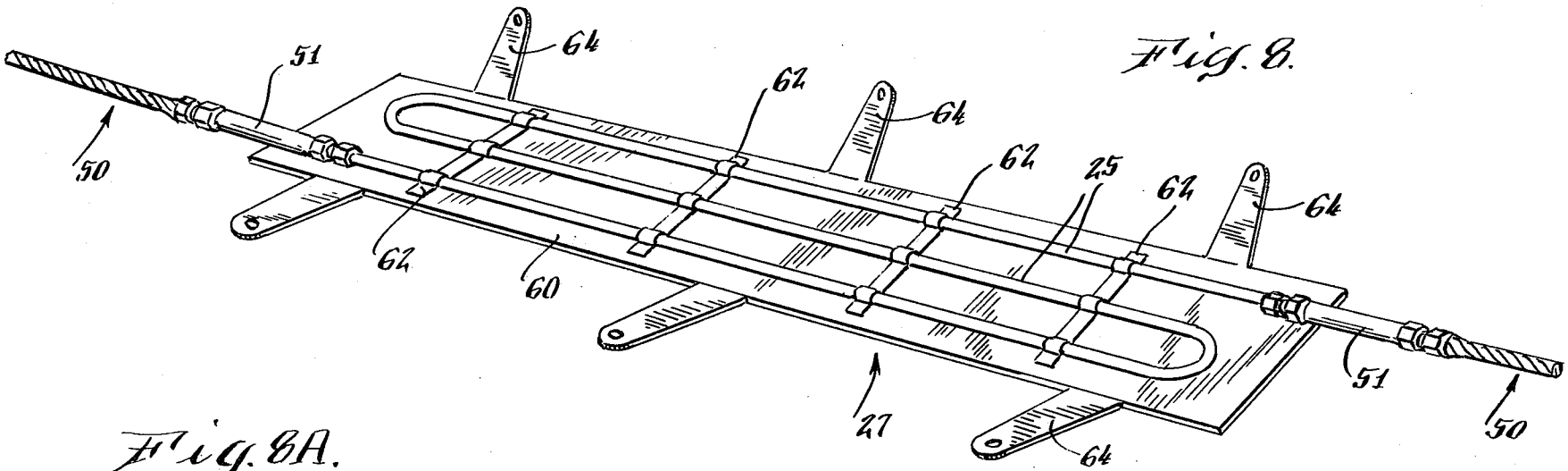
FIG. 8 is a perspective view of a crib heating unit of the apparatus.

The apparatus is made to serve effectively as well in the crib regions of rods interconnecting the displaceable rail end portions 3A and 4A near the switch points, such as the crib space 10 of throw rod 6 and the crib space 14 of tie rod 12, by the crib heating units 27 and 27A, one of which is illustrated bottom-side-up in FIG. 8.

Each crib heating unit 27 or 27A comprises essentially a unitary elongate, substantially flat pan-like support 60 of thermally conductive, heat and weather resistant sheet material, such as, for instance, a piece of stainless steel sheeting about 0.015 inch thick, about 10 inches wide and about 5 feet long, with a sinuously bent length 25 or 25A of the heating cable arranged over and held to a surface of the support 60 so as to heat the support substantially uniformly by conduction to a well elevated temperature, and a connector 51 fixed to each end of the cable length connects it with the "cold" wire of an insulated conductor 52 in the current supply circuit 50. The cable length is held to a surface of the support 60, preferably to its underside as shown in FIG. 8, by any suitable means such, for instance, as stainless steel bands 62 applied over the cable and welded to the support surface at intervals therealong.

The support 60 with the cable length fixed to it is easily slid into a crib space 10 or 14 beneath the rod 6 or 12, between and along the track ties bordering the crib space. The thinness and pan-like form of the support and the bendability of the cable fixed to it enable the unit to be adapted readily to the dimensions and any restrictions of the crib space. The unit can be fastened in place advantageously by heat and weather resistant straps 64, such as strips of the stainless steel sheeting which are welded to the support 60 at spaced intervals therealong and extend from its opposite side edges so as to be nailed or screwed onto the bordering ties.

The pan-like support of the crib heating unit in use distributes the heat from the cable length 25 substantially uniformly over the area of the support 60 and thence by radiation and convection from its upwardly facing surface throughout the crib region of the rod interconnecting the switch rails. Any snow or ice reaching its surface is melted. The heat distribution from its surface prevents snow and ice from accumulating in the crib space, with avoidance of the above mentioned "igloo"effect, and keeps heat from being drained excessively from the switch rails through the rod in the crib space.

The crib heating unit 27 as shown in FIG. 8 has the cable length 25 arranged over the under surface of the support 60 in three substantially parallel legs extending along the support and joined to one another by bends of the cable near opposite ends of the support, with the ends of the cable length disposed at opposite ends of the support and fitted with connectors 51 for joining them with conductors forming parts of the heating circuit 50 at opposite sides of the switch track.

Figure 8A:
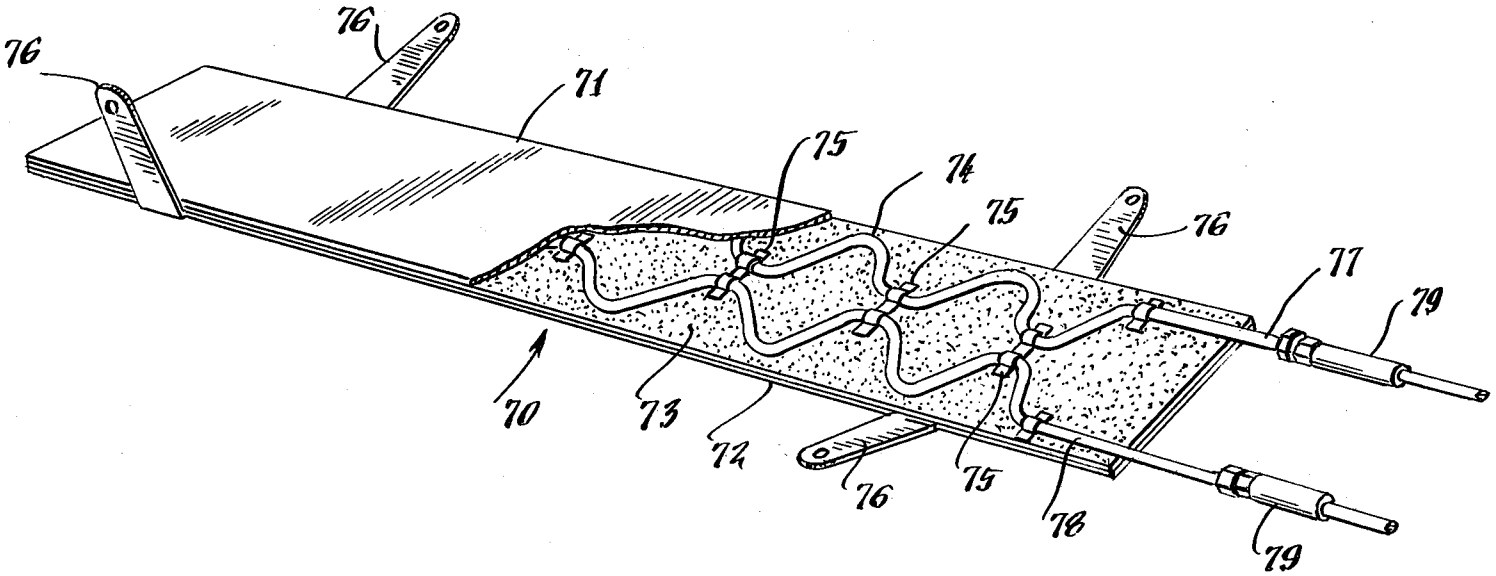
FIG. 8A is a perspective view of another form of the crib heating unit.
Figure 9:
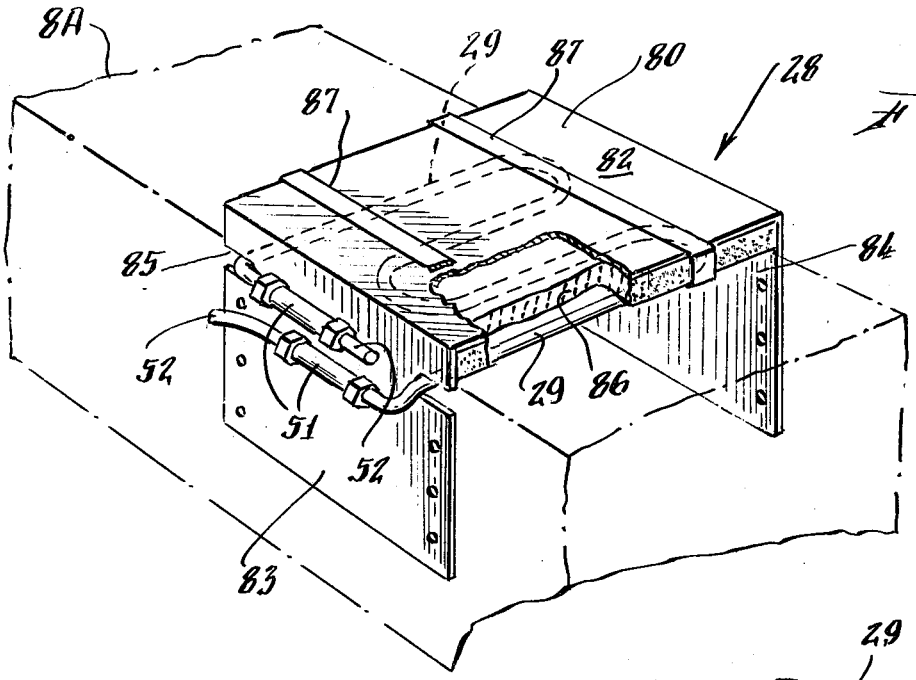
FIG. 9 is a perspective view of a gauge plate heating unit of the apparatus.
Figure 10:
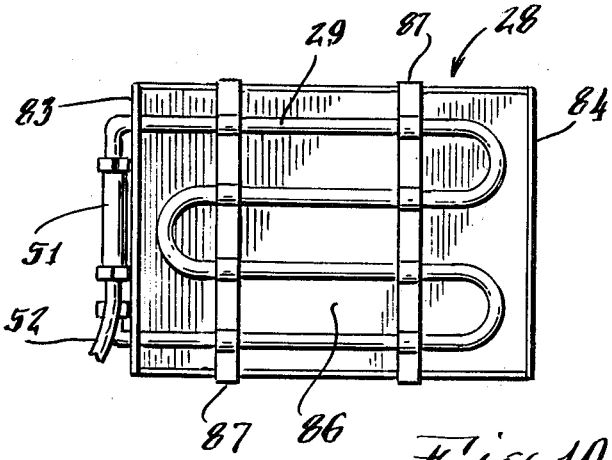
FIG. 10 is a bottom plan view thereof.

FIG. 8A shows another suitable form 70 of the crib heating unit. This unit differs from unit 27 principally in that the pan-like support is formed by two layers 71 and 72 of substantially flat weather-resistant sheet material, such as stainless steel sheeting about 0.015 inch thick, with a length 74 of the heating cable 30 arranged in two sinuously bent legs on one of the sheets and sandwiched between the two sheets. The lower sheet 72 is provided with a layer 73 of heat insulating material to restrict heat losses downward into the track bed. Strips 75 hold the cable length to one of the support sheets. Straps 76 corresponding to the straps 64 of FIG. 8 are fastened to ties to hold the unit in place in a crib space. The sinuous cable legs are joined by a bend of the cable near one end of the support, and at its other end their ends 77 and 78 are fitted with connectors 79 for joining them with conductors forming parts of the heating circuit at one side of the switch track. The cable length 74 as shown in FIG. 8A is enclosed in a length of tubing 38.

A switch heating system comprising the rail heating cable lengths 22 and 23 and one or more crib heating units such as units 27 and 27A suffices to prevent malfunction of the switch under the winter weather conditions to be expected in many climatic regions. In regions that experience extremely cold weather, however, conditions may occur under which ice would still form so as to obstruct the operation of a switch having a gauge plate, such as plate 16, extending between the stock rails at the location of the switch rail points. Portions of the gauge plate extending between the switch points may dissipate heat so rapidly in extreme weather that ice or snow at the switch points may not be melted by the heat from the stock rails, or if melted may leave water that will freeze on the switch points or between them and the stock rails upon a further drop of the ambient temperature.

This problem is overcome by the supplemental heating action of the gauge plate heating units 28 and 28A. As shown in FIGS. 1, 3, 4, 9 and 10, each of these units comprises a rigid plate member 80, such as an aluminum plate about 0.1 inch thick formed to a saddle shape. The plate member has a substantially flat base wall 82 that overlies the surface of the gauge plate 16 adjacent to a switch rail point 3B and 4B, with depending side walls 83 and 84 that straddle and are fastened to opposite sides of the tie 8B supporting the gauge plate. A layer 86 of heat insulating material, such for instance as a 1-inch thick layer of K-FAX insulation, is provided on the under side of the base wall 82, and a sinuously bent length 29 or 29A of the heating cable is arranged on the insulating layer, preferably in a groove formed in it, so that the base wall 82 holds the cable length against the gauge plate surface with the insulating layer overlying the cable. The cable length may be fastened in place by metal straps 87, such as 0.015" thick by 1" wide stainless steel strapping, fixed about the plate member. Each cable length such as 29 or 29A comprises a length of the cable 30 enclosed in a coextensive length of tubing 38, with each end of the cable and tubing protruding from beneath wall 82 through a notch 85 in side wall 83 and into a connector 51 joining the end with a conductor 52 in the switch heating circuit 50.

Thus, when the switch heating circuit is active the heat generated in the cable lengths 29 and 29A passes in major part by conduction directly into the gauge plate 16 over its surface areas adjacent to the switch points 3B and 4B, and passes through the gauge plate beneath and into the switch points so that ice formation obstructing movement of the switch points will not occur under even the most severe cold weather conditions.

Figure 11:
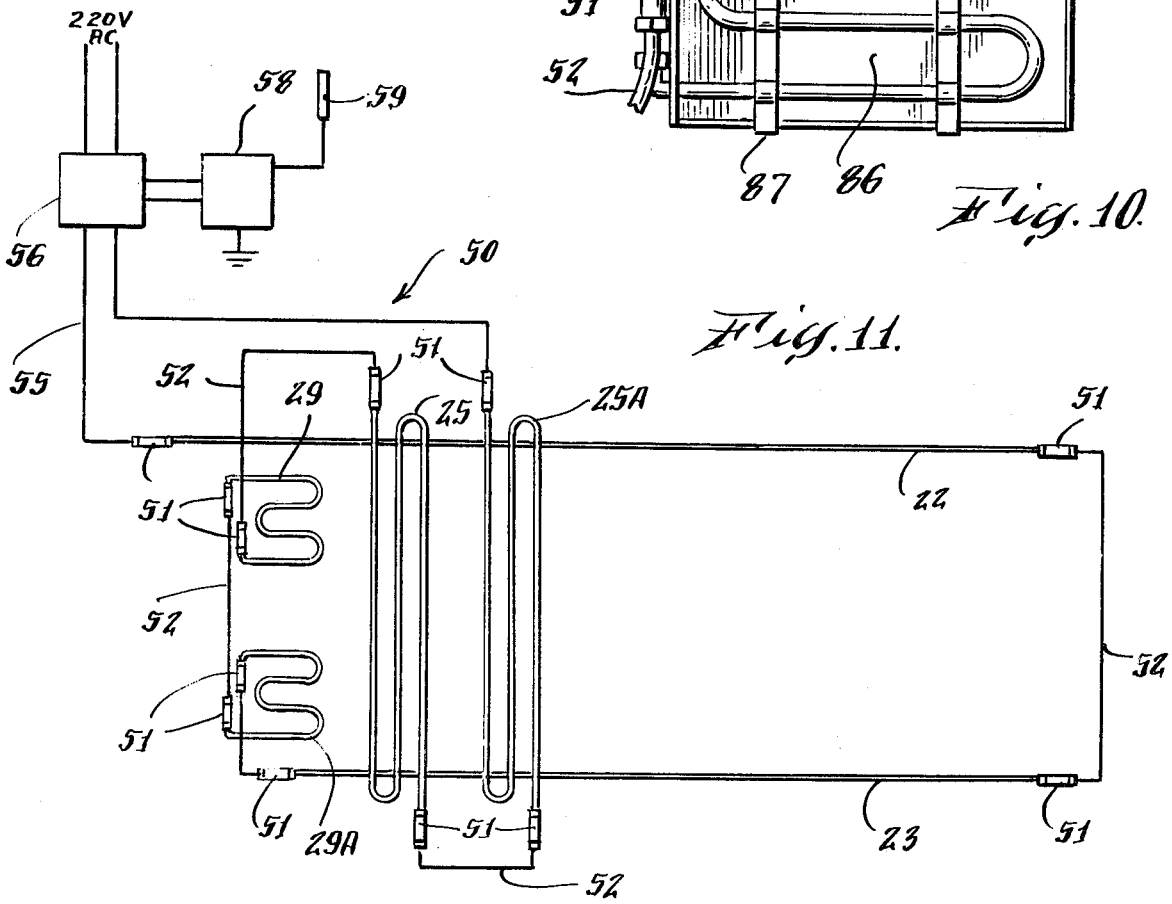
FIG. 11 is a schematic diagram of an electrical circuit for the apparatus.

As indicated in FIGS. 1 and 11, the respective resistance wires 32 of the heating cable lengths 22, 23, 25, 25A, 29 and 29A are connected in series in the current supply circuit 50 by connectors 51 at the respective ends of these wires. Each connector 51 joins an end of the "hot" wire of a cable length with a "cold" wire of an insulated conductor 52, for instance a No. 6 gauge direct burial wire, forming part of the circuit. The circuit 50 includes a power supply line 55 that may extend from a conventional railroad junction box 56. The circuit when desired may include a controller 58 that receives signals from a thermocouple 59 sensing the ambient temperature at the railroad switch location and acts in response to these signals to turn on the power supply circuit 50 when the ambient temperature falls below a preset limit of, for example, about 35° F. and to turn off the power supply when the ambient temperature rises above the preset limit.

The construction of a suitable connector 51 is shown in FIGS. 7A and 7B. Each connector 51 comprises a tubular core member 90 of electrically and thermally conductive metal, such as brass or copper, which serves as a heat sink. A bared end of wire 32 of a length of the heating cable 30 is inserted into and fastened in one end of member 90, and a bared end of the wire 92 of an insulated conductor 52 is inserted into and fastened in the other end of member 90. The core member 90 may be crimped so as to clamp the wire ends permanently in place. Preferably, however, member 90 is made of brass and is formed with screw-threaded radial bores 93 in which set screws 94 are fitted so that the wire ends will be clamped releasably in place by the screws, thus enabling quick disconnection and removal, or quick connection, of either of the wire ends whenever desired for disassembly or assembly of any of the components of the switch heating system.

The tubular core member 90 with the wire ends attached is enclosed in a surrounding electrical insulator 96 of heat resistant insulation, such for instance as a tube of "Teflon" about 1/16 inch thick, and the insulation in turn is confined inside a rigid sleeve 97 which has coupling rings 98 and 99 fixed onto its ends. The sleeve 97, for instance, is a 6½ inch long piece of aluminum tubing having an inside diameter of about 9/16 inch, and is externally screw-threaded at each of its ends. Each of the coupling rings 98 and 99 is internally threaded so as to screw onto one of the sleeve ends, and has an externally threaded shank 98A or 99A for connecting it with an internally threaded cap ring 100, or with a screw collar 101. The cap ring 100 receives a compressible ring 102 that fits onto an end 103 of a tubing length 38 enclosing the length of heating cable 30, and it is fastened to the tubing end by compressing the ring 102 onto it when ring 100 is screwed onto the shank 98A. Collar 101 is coupled with the end of a spiral spring shield 104 that fits over and extends along a portion of the insulated conductor 52 near the connector 51 so as to protect the conductor 52 from injury by limiting access to it and limiting the angle to which it can be bent when assembled in the heating system.

An insulating ceramic bead 105 that can be slid through the coupling ring 98 is fitted over the bared end and up to the insulation 34 of the heating wire 32 at one end of core member 90, thus holding the end of cable sheath 36 away and insulated from member 90. A length of the insulated conductor 52 inside the sleeve 97 and coupling ring 99 is embedded in a mass 110 of a flexible silicone sealing compound to prevent moisture from entering the connector yet permit expansion and contraction of the core member 90 and the joined wires. An insulating heat resistant elastic bushing 106, made e.g. of a material such as Neoprene, and an adjacent washer 107, both of which fit inside the collar 101, are fitted over the end of the insulated conductor 52 so that the bushing 106 will be pressed and sealed against this conductor and against an inner surface of the shank 99A of coupling ring 99 when the collar 101 is screwed into engagement with ring 99.

By virtue of the described construction, each of the connectors 51 in the switch heating circuit makes a secure yet readily separable electrical connection between adjacent ends of a "hot" wire and a "cold" wire of the circuit, and one which accommodates the thermal expansions and contractions of the wires and connector parts, while also serving effectively as a heat barrier to prevent injurious flow of heat from the hot wire to the insulated conductor and, in addition, rendering the electrical joint substantially water-tight so that it will not be affected by water or other liquid at the switch location.

Whenever it is desired to remove a heating cable length or a conductor in the circuit, each related wire end at a connector 51 can be quickly disconnected, for instance, by detaching the coupling rings 98 and 99 and the collar 101 of the connector, sliding the collar 101 and spring shield 104 away from the sleeve 97, sliding the sleeve 97 and the insulation 96 off the core member 90, and turning set screws 94 to release the wire end for removal from the core member. Quick reconnection of a wire end of course can be effected by reversal of these steps.

The switch heating system herein disclosed provides a unique combination of ruggedness and effectiveness with low power consumption in use. The stock rails are heated directly by conduction, with highly efficient utilization of the cable heat. They in turn serve as the principal agency for melting ice and snow, and at the region of the switch rail points, where the need for elimination of ice and snow is most critical, their heating action is reinforced and supplemented by the convective and radiant heating action of the crib heating unit or units, and also, where needed, by the conductive heating action of the gauge plate heating units. The system produces a safe, relatively low temperature in the heated components of the switch. The water-tight connectors and the tubing lengths enclosing the heating cable lengths assure long trouble-free operation of the system. Further, the components of the heating system can be installed properly at a railroad switch by railroad workmen, typically requiring only about two to four hours for installation, and can be disassembled if desired in about a half hour or less.

I claim:

1. A heating system for a railroad switch including fixed rails engaged by braces and fastened to track ties, switch rails having end portions displaceable laterally relative to the fixed rails, and at least one rod interconnecting and displaceable with said rail end portions, each said rod extending along a crib space between adjacent ties, said fixed rails being positioned on a gauge plate fastened onto a track tie and on which plate the displaceable rail end portions are slideable to and from the fixed rails, said system comprising:

a length of electrical heating cable disposed against and along a side of each said fixed rail and braces thereof in heat conducting relation thereto through the region of said displaceable rail end portions and elongate mats of high temperature resistant thermal insulation confined against the portions of said cable lengths not engaged with rail braces, and against the rail surfaces adjacent to said cable portions, to prevent heat losses by convection and radiation; and a crib heating unit fitting into a said crib space beneath and along the rod therein, said crib heating unit comprising a unitary elongate, substantially flat pan-like support of thermally conductive, heat and weather resistant sheet material dimensioned to fit between and along the ties bordering the crib space and a sinuously bent length of electrical heating cable arranged over and held to a surface of said support so as to heat said support substantially uniformly by conduction and thus heat substantially the entire crib space by convection and radiation, said gauge plate having fitted over a surface thereof adjacent to each of said displaceable rail end portions a heating unit comprising a rigid plate member having a substantially flat base wall overlying said gauge plate surface and having depending side walls fastened to opposite sides of the track tie under the gauge plate, a layer of heat insulating material fixed beneath said base wall, and another sinuously bent length of a said heating cable arranged on and held to said insulating layer and held by said plate member directly against said gauge plate surface for heat conduction into the gauge plate, each end of the heating wire of said other bent cable length protruding from beneath said base wall into means for connecting the wire in said circuit.

2. A switch heating system according to claim 1, each of said cable lengths being enclosed inside a substantially coextensive length of water-impervious, bendable metal tubing whereby the switch heating system is substantially waterproof.

3. A switch heating system according to claim 2, each of said cable lengths comprising an electrically insulated, electrical resistance heating wire having on each end thereof a substantially watertight connector comprising a heat-absorbing electrically conductive core member receiving and clamped onto both the heating wire end and an end of a cold wire of an insulated electrical conductor, said core member being enclosed in insulating material confined inside a sleeve having a coupling ring fixed onto each of its ends, an annular cap ring fixed onto an end of said tubing length and joined with one of said coupling rings, and a protective flexible shield fitted over and along said conductor and carrying a collar joined with the other of said coupling rings.

4. A switch heating system according to claim 3, said heating wire being held spaced inside said sleeve by an insulating ceramic bead on said heating wire at said core member and said conductor being held aligned with said core member by a heat-resistant elastomer bushing fitted on said conductor inside said collar, said bushing being pressed against a said coupling ring and against said conductor by said collar.

5. A gauge plate unit for heating a rail positioning gauge plate fastened onto a tie of a railroad switch, said unit comprising a rigid plate member having a substantially flat base wall to overlie a surface of the gauge plate adjacent to a displaceable switch rail end portion and having depending side walls fastenable to opposite sides of said tie under the gauge plate, a layer of heat insulating material fixed beneath said base wall, and a sinuously bent length of an electrical heating cable arranged on and held to said insulating layer so as to be held by said plate member directly against said surface for heat conduction into the gauge plate.

6. A gauge plate unit according to claim 5, said cable length comprising an electrical resistance heating wire encased in high temperature resistant electrically insulating material confined inside a thermally conductive, pliable metal sheath, said wire at each end of said cable length protruding from beneath said base wall and having thereon means for connecting the wire in a circuit containing a source of current for heating the wire to high temperature.

7. A gauge plate heating unit according to claim 5 or 6, said cable length being enclosed inside a substantially coextensive length of water-impervious, bendable metal tubing.

8. A gauge plate heating unit according to claim 7, said cable length comprising a heating wire having on each end thereof a substantially water-tight connector comprising a heat-absorbing electrically conductive core member receiving and clamped onto the heating wire end and to receive and be clamped onto an end of a cold wire of an insulated electrical conductor, said core member being enclosed in insulating material confined inside a sleeve having a coupling ring fixed onto each of its ends, and an annular cap ring fixed onto an end of said tubing length and joined with one of said said coupling rings, the other of said coupling rings being adapted to be joined with a collar carried by a protective flexible shield fitted over and along said conductor.

* * * * *